US005230354A

United States Patent [19]

Smith et al.

[11] Patent Number: 5,230,354

[45] Date of Patent: Jul. 27, 1993

[54] TOBACCO PROCESSING

[75] Inventors: Leigh A. B. Smith, Clemmons; James R. Dodson, Walnut Cove, both of N.C.

[73] Assignee: R. J. Reynolds Tobacco Company, Winston-Salem, N.C.

[21] Appl. No.: 753,508

[22] Filed: Sep. 3, 1991

[51] Int. Cl.[5] ..... A24B 15/18

[52] U.S. Cl. ..... 131/297; 131/298

[58] Field of Search ..... 131/297, 298

[56] References Cited

U.S. PATENT DOCUMENTS 3,616,801 11/1971 Hind .
3,847,164 11/1974 Mattina et al. .
4,131,117 12/1978 Kite et al. .
4,131,118 12/1978 Gellatly et al. .
4,364,401 12/1982 Keritsis .
4,566,469 1/1986 Semp et al. .
4,986,286 1/1991 Roberts et al. ..... 131/297 X
5,025,812 6/1991 Fagg et al. .
5,060,669 10/1991 White et al. ..... 131/297
5,121,757 6/1992 White et al. ..... 131/297

FOREIGN PATENT DOCUMENTS 070112 1/1983 European Pat. Off. .
076642 4/1983 European Pat. Off. .

*Primary Examiner*—V. Millin
*Assistant Examiner*—J. Doyle

[57] ABSTRACT

Burley tobacco stems are extracted with tap water to provide a water soluble extract and a water insoluble pulp. The extract and water are separated from the pulp. The extract is provided within the water at a concentration at least about 30 percent, based on the weight of the extract and water. Then, the extract and water are heated to about 200° F. The extract and water then is cooled to ambient temperature. Potassium nitrate crystals form as a precipitate and are separated from the extract and water.

14 Claims, 1 Drawing Sheet

TOBACCO PROCESSING

BACKGROUND OF THE INVENTION

The present invention relates to tobacco, and in particular to a process for changing the character of tobacco extracts and tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. As such, cigarettes usually incorporate tobacco cut filler including certain amounts of processed reconstituted tobacco materials. Certain processed tobacco materials are cut rolled and cut puffed tobacco stems. Certain reconstituted tobacco materials are manufactured from tobacco stems, dust and scrap using papermaking processes. See, for example, U.S. Pat. Nos. 4,131,117 to Kite, et al.; 4,421,126 to Gellatly; 4,962,774 to Thomasson, et al. and 4,987,906 to Young, et al; as well as U.S. patent application Ser. No. 710,273, filed Jun. 4, 1991.

Oftentimes, tobacco is chemically or physically treated to selectively remove certain components therefrom. See, for example, U.S. Pat. Nos. 4,131,117 to Kite, et al., and 5,025,812 to Fagg, et al. and U.S. patent application Ser. No. 484,587, filed Feb. 23, 1990 U.S. Pat. No. 5,065,775.

It would be desirable to provide a process for efficiently and effectively altering the chemical nature or composition of tobacco; and in particular, to provide a process for removing selected components from tobacco extracts or other types of tobacco materials.

SUMMARY OF THE INVENTION

The present invention relates to a process for changing the character of tobacco; in particular, to a process for removing certain components of tobacco extracts therefrom. The process involves extracting components from a tobacco material under extraction conditions using an extraction solvent having an aqueous character. As such, an aqueous tobacco extract and a water insoluble tobacco portion (i.e., extracted tobacco material) are provided. At least a portion of the aqueous extract is separated from the insoluble portion; and preferably, as much of the aqueous extract as possible is separated from the insoluble portion. The tobacco extract provided by such an extraction is provided within extraction solvent, preferably at a concentration of at least about 30 percent, based on the weight of extract and solvent. The extract and solvent are subjected to heat treatment, preferably to a temperature of at least about 120° F., and preferably about 130° F. to about 200° F. Then, the extract and solvent are cooled under conditions sufficient to cause certain components of the extract to crystallize or form a precipitate. Typically, the extract and solvent are cooled to a temperature below about 100° F. Then, the crystalline material or precipitate is separated from the liquid solvent and extract. The liquid solvent and extract then can be employed in the manufacture of smoking articles, such as cigarettes. For example, the liquid solvent and extract can be (i) spray dried or otherwise further processed, (ii) used in the manufacture of reconstituted tobacco materials, (iii) applied to the extracted tobacco material resulting from the previously described extraction of the tobacco material using the extraction solvent, or (iv) applied to substrates (e.g., alumina beads, gathered paper or non-woven thermoplastic web).

DETAILED DESCRIPTION OF THE PREFERRED EMBODIMENTS

Figure 1:
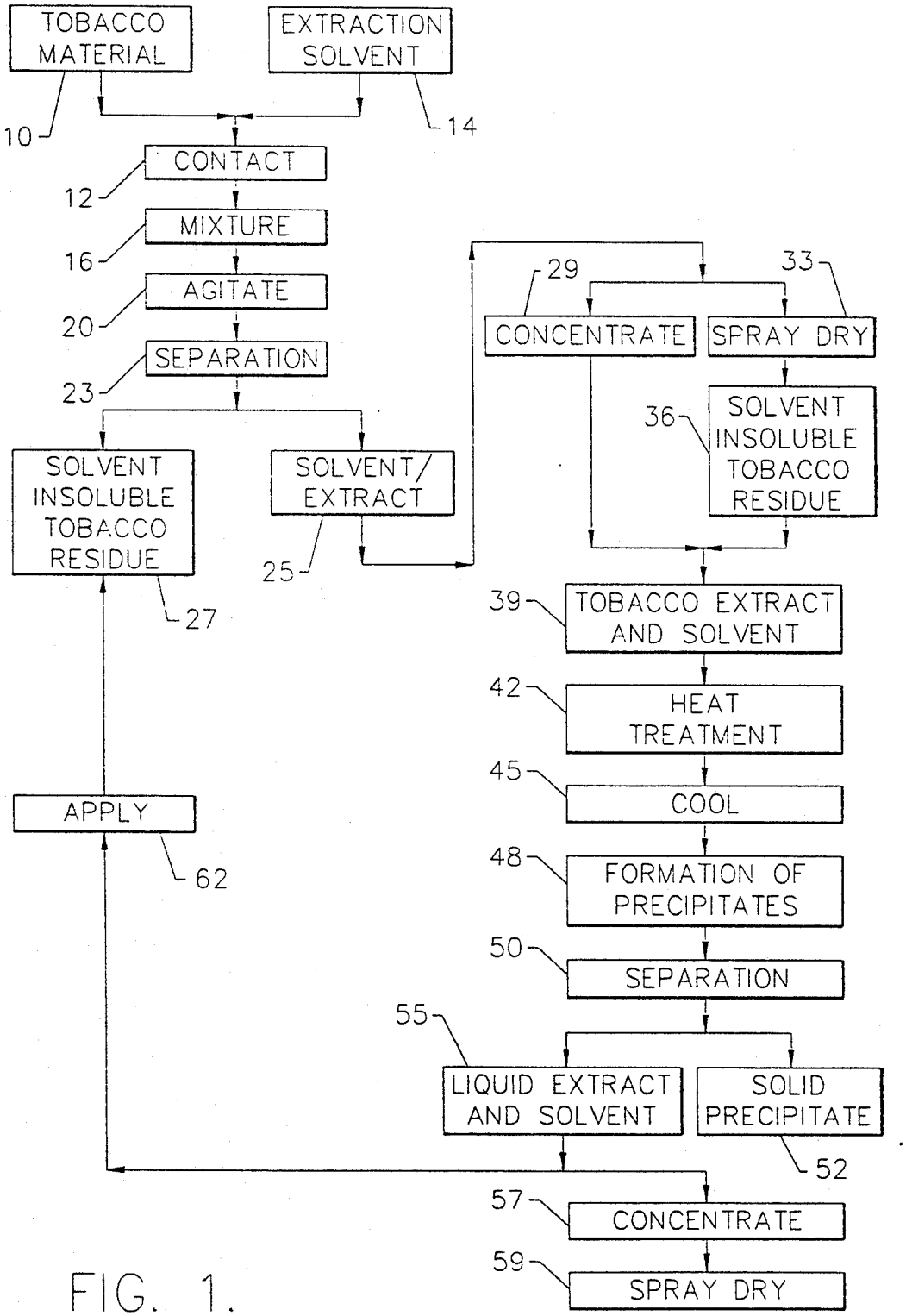
FIG. 1 is a schematic diagram of the process steps representative of an embodiment of the present invention.

Referring to FIG. 1, tobacco material 10 (e.g., Burley tobacco stem) is contacted 12 with a liquid solvent 14 (e.g., tap water heated to about 140° F.) resulting in a mixture 16 of solvent and tobacco material. The mixture 16 (e.g., slurry) can be agitated 20 in order to enhance removal (i.e., extraction) of water soluble components from the tobacco material 10 by the solvent 14. As such, the tobacco material is subjected to extraction conditions.

The mixture is subjected to separation conditions 23 so as to provide a tobacco extract within solvent (e.g., an aqueous tobacco extract 25) and a water insoluble tobacco residue 27 (e.g., extracted tobacco pulp). The aqueous tobacco extract 25 can be concentrated 29 (e.g., using vacuum techniques) for further processing. Alternatively, the aqueous tobacco extract can be spray dried 33, for storage and handling reasons, and later contacted 36 with extraction solvent for further processing.

Tobacco extract within solvent 39, which preferably is at a concentration above about 30 percent, based on the weight of extract and solvent, is subjected to heat treatment 42. Such treatment involves heating the extract and solvent to a temperature above about 120° F. Then, the heat treated liquid aqueous extract is cooled 45, so as to cause formation of precipitates 48. Then, the precipitates are separated 50 from the liquid solvent and extract (e.g., using filtration techniques of a centrifuge), thereby yielding collected solid precipitates 52 and a liquid solvent and extract 55 essentially absent of precipitates. Then, the liquid solvent and extract optionally is concentrated 57 and spray dried 59 for further use. Alternatively, the solvent and extract 55 is applied 62 (i.e., recombined) with the insoluble tobacco residue 27.

The tobacco material which is processed according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. The type of tobacco can vary; however, the tobacco material typically is a Burley tobacco material or includes a blend of various types of tobacco materials including a Burley tobacco material. Normally, the tobacco has been aged. The tobacco material can be in the form of whole leaf, strip (e.g., laminae), cut filler, stem, cut or processed stem, scrap, dust, fines, stalk, or the like. The aforementioned tobacco materials can be processed separately, or as blends thereof. Typically, the tobacco material includes Burley tobacco stem or stem pieces.

The tobacco material is contacted with an extraction solvent, such as an extraction solvent having an aqueous character. A solvent having an aqueous character consists primarily of water, is normally greater than about 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. The solvent can have pH adjusters, pH buffers, or other soluble or dispersible additives incorporated therein. Representative methods for extracting tobacco materials using solvents are set forth in U.S. Pat. Nos. 5,005,593 to Fagg; and 5,025,812 to Fagg, et al.; and U.S. patent application Ser. No. 505,339, filed Apr. 5, 1990, now U.S. Pat. No. 5,095,922; Ser. No. 484,587, filed Feb. 23, 1990, now U.S. Pat. No. 5,065,775; Ser. No. 680,207, filed Apr. 4 1991; Ser. No. 720,308, filed Jun. 25, 1991; and Ser. no. 733,477, filed Jul. 22, 1991; which are incorporated herein by reference.

The amount of tobacco material which is contacted with the extraction solvent can vary. Typically, for a batch-wise extraction, the weight of extraction solvent relative to the tobacco material is greater than about 6:1, often greater than about 10:1, and frequently greater than about 15:1. Typically, for a continuous extraction, the weight of extraction solvent relative to tobacco material is greater than about 4:1, often greater than about 10:1, and frequently greater than about 14:1.

The conditions under which the extraction is performed can vary. Conditions of temperature can be less than, greater than, or equal to, ambient temperature. Typical temperatures range from about 40° F. to about 190° F., often about 50° F. to about 160° F. and frequently about 60° F. to about 150° F. The solvent-/tobacco material mixture can be agitated (e.g., stirred, shaken or otherwise mixed) in order to increase the rate at which extraction occurs. Typically, for a batch-wise extraction, adequate extraction of components occurs in less than about 60 minutes, oftentimes in less than about 30 minutes.

The extraction solvent and tobacco extract then are separated from the insoluble tobacco residue. The manner of separation can vary; however, it is convenient to employ conventional separation techniques such as filtration, centrifugation, or the like. It is desirable to provide a solution of solvent and extract having a very low level of suspended solids. Preferably, the insoluble residue is treated so as to remove a large amount of solvent and tobacco extract therefrom.

The solvent and tobacco components extracted thereby can be filtered to remove suspended insoluble particles; concentrated; diluted with solvent; or spray dried, freeze dried, or otherwise processed, particularly for storage or handling reasons. Dried extracts, such as spray dried tobacco extracts, can be later redissolved in extraction solvent for later treatment and further extraction process steps.

The tobacco extract is provided within extraction solvent. The concentration of tobacco extract within extraction solvent most preferably is greater than that provided during extraction conditions. Typically, the concentration of extract within solvent is at least about 30 percent, often greater than about 35 and frequently greater than about 40 percent, based on the weight of extract and solvent. Typically, the concentration of extract within solvent is less than about 50 percent, and often less than about 45 percent, based on the weight of extract and solvent. If desired, additives can be combined with the extract and solvent. For example, flavors, acids, sugars, syrups, and the like, can be combined with the extract and solvent.

The extract and solvent are heat treated. Typically, the extract and solvent are heated to a temperature significantly higher than ambient temperature. Typically, the extract and solvent are heated to a temperature of at least about 120° F., generally at least about 130° F., often at least about 140° F., and frequently at least about 150° F. Normally, the solvent and extract are not heated above about 250° F. Usually, the extract and solvent are heated to a temperature of about 120° F. to about 220° F., often about 130° F. to about 200° F., and frequently about 140° F. to about 180° F. The extract and solvent typically are heat treated under conditions of ambient pressure, although such heat treatment also can be performed in a pressure controlled environment (e.g., in a sealed high pressure vessel). The rate at which the extract and solvent are heated can vary, and often depends upon the type of equipment used to heat the extract and solvent. Manners and methods for heating extract and solvent will be apparent to the skilled artisan. The time period over which the extract and solvent are subjected to heat treatment at a particular maximum temperature can vary, and can range from relatively brief (e.g., less than one minute) to relatively long (e.g., about two hours, or more). Preferably, the extract and solvent are maintained at a maximum temperature of about 130° F. to about 200° F. for about 1 minute to about 1 hour.

After heat treatment has been performed, the extract and solvent are cooled. The rate of cooling can vary, and manners and methods for cooling extract and solvent will be apparent to the skilled artisan. Typically, the extract and solvent are cooled to a temperature below about 110° F., generally below about 100° F., and often to ambient temperature (e.g., about 60° F. to about 90° F.). Although not necessary, the extract and solvent can be cooled to below ambient temperature. However, the extract and solvent normally are not cooled to below about 35° F., often are not cooled to below about 40° F., and frequently are not cooled to below about 45° F.

The temperature at which precipitates begin to form can vary, depending upon factors such as the concentration of the extract within the solvent, and temperature to which the extract and solvent are heated. For example, when the extract and solvent are heated to a temperature above about 150° F., precipitates typically begin to form when the extract and solvent reaches about 125° F., or less; and when the extract and solvent are heated to a temperature of about 120° F. to about 135° F., precipitates typically begin to form when the extract and solvent reaches about 100° F., or less.

The solid precipitate which forms and is insoluble in the liquid extract and solvent is separated from the extract and solvent. The manner of separation can vary, and can involve filtration (i.e., using cheesecloth), centrifugation, or other techniques which will be readily apparent to the skilled artisan.

The extract can be further treated or processed. The extract and solvent can be contacted with ion exchange resins, activated carbon particles, or the like, or subjected to electrodialysis treatment. For example, the extract and solvent can be contacted with granular lignite carbon or particles of bituminous coal, agitated or otherwise mixed, and then separated from one another. Typically, contact of the extract and solvent with activated carbon particles is provided by (i) contacting the extract and solvent with about 1 to about 10 weight percent carbon particles, or (ii) passing the extract and solvent through a carbon bed (e.g., a filter bed or column).

The solvent and extract absent of precipitates can be employed in a variety of ways. For example, it is desirable to subject the liquid extract to a spray drying, freeze drying, belt drying, flash drying, or other suitable solvent removal process in order to provide a tobacco extract in a substantially solvent-free form. As such, the tobacco extract can be processed to have the form of a paste, a viscous liquid, a powder, a granular solid, a gel, or the like. Tobacco extracts can be processed (e.g., freeze dried or spray dried) as described in U.S. Pat. Nos. 3,316,919 to Green and 5,005,593 to Fagg; European Patent Application No. 338,831; as well as U.S. patent application Ser. No. 680,207 filed Apr. 4, 1991. Typically, tobacco extracts are provided in the form of spray dried extracts, freeze dried extracts, or the like.

The tobacco extract can be provided at a predetermined solvent level (e.g., in a predetermined high moisture form) by removing the solvent from the collected mixture of solvent and extract. Vacuum distillation, reverse osmosis and thin film evaporation techniques are particularly useful. If desired, further solvent can be added to the tobacco extract. If desired, the extract can be employed to provide reconstituted tobacco materials or other types of processed tobacco materials by recombining the extract with the insoluble tobacco material or tobacco pulp provided during the extraction steps of the process of the present invention. For example, the extract can be recombined with tobacco pulp using the types of techniques described in U.S. patent application Ser. No. 484,587, filed Feb. 23, 1990, now U.S. Pat. No. 5,065,775; Ser. No. 710,273, filed Jun. 4, 1991 and Ser. No. 733,477, filed Jul. 22, 1991.

The tobacco extract can be subjected to further heat treatment as described in U.S. patent application Ser. No. 452,175, filed Dec. 18, 1989, now U.S. Pat. No. 5,060,669; Ser. No. 536,250, filed Jun. 11, 1990; and Ser. No. 710,273, filed Jun. 4, 1991; which are incorporated herein by reference.

The tobacco extracts so provided are useful as forms of tobacco for smoking products. For example, such tobacco extracts are useful as casing or top dressing components for tobacco laminae and cut filler, as well as for other smokable materials. Such tobacco extracts can be employed as a form of tobacco in those types of smokable materials described in U.S. Pat. No. 4,920,990 to Lawrence, et al., and European Patent Application Nos. 280,990 and 419,733. Alternatively, such tobacco extracts are useful as one form of tobacco employed in those types of smoking articles described in U.S. Pat. Nos. 4,708,151 to Shelar; 4,771,795 to White, et al.; 4,714,082 to Banerjee, et al.; 4,756,318 to Clearman, et al.; 4,793,365 to Sensabaugh, et al.; 4,827,950 to Banerjee, et al.; 4,819,665 to Roberts, et al.; 4,854,311 to Banerjee, et al.; 4,881,556 to Clearman, et al.; 4,893,639 to White, et al.; 4,928,714 to Shannon; 4,938,238 to Barnes, et al.; 4,947,874 to Brooks, et al.; 4,955,399 to Potter, et al.; 4,991,596 to Lawrence, et al.; and 5,027,837 to Clearman, et al.; U.S. patent application Ser. No. 642,233, filed Jan. 23, 1991; and European Patent Application No. 342,538. The tobacco extracts are useful as cigarette filter additives. For example, the tobacco extracts can be incorporated into low density polyethylene and formed into strands; and then incorporated into cigarette filters as described in U.S. Pat. Nos. 4,281,671 to Bynre, et al. and 4,862,905 to Green, Jr., et al. The tobacco extracts are also useful in those smoking articles described in U.S. patent application Ser. Nos. 606,287, filed Nov. 11, 1990 and 621,499, filed Dec. 7, 1990. The tobacco extracts also are useful as cigarette wrapper additives; or as additives to the inner regions of cigarette packages (e.g., within a paper/foil laminate of a cigarette package or within a low density polyethylene film which is placed within a cigarette aroma and "pack aroma." See also, U.S. patent application Ser. No. 696,700, filed May 7, 1991.

The process can be used to remove significant amounts of potassium nitrate from tobacco extracts provided by the extraction of Burley tobacco stems with a solvent having an aqueous character. For example, at least about 10 percent, up to about 65 percent, usually about 15 to about 60 percent, and often about 20 to about 55 percent, of the potassium nitrate present in such an extract can be removed therefrom using the process of the present invention.

The following examples are provided in order to further illustrate the invention but should not be construed as limiting the scope thereof. Unless otherwise noted, all parts and percentages are by weight.

EXAMPLE 1

Aged Burley tobacco in stem form is extracted using water to provide an aqueous tobacco extract having a relatively high content of tobacco extract, essentially as follows:

Aged Burley tobacco stem, in pieces having lengths of about 0.5 inch to about 2 inches, and maximum widths of up to about 0.25 inch, is provided.

A continuous counter current extractor available as CCE Model No. 1000 from Counter Current Technology Pty. Ltd. is provided. The trough of the extractor is filled with tap water at about 160° F. to about 165° F. The trough is positioned at 4° relative to horizontal so that tobacco material introduced at one end of the trough travels upwards during continuous extraction and water introduced at the other end of the trough travels downwards during continuous extraction. The screw of the extractor is standard for that extractor purchased, and a screen is positioned upstream from the tobacco material input region.

The screw is operated alternately for 20 seconds forward at a speed of 1.88 rpm and for about 15 seconds reverse at a speed of 1.88 rpm. The screw is not rotated (i e., experiences a pause time for 1 second) each time the screw changes direction of operation. Tobacco stem material is introduced continuously into the extractor at a rate of about 750 to about 800 pounds/hour, and tap water at about 160° F. to about 165° F. is fed continuously through the extractor at a rate of about 2700 to about 3000 pounds/hour.

The residence time of the tobacco stem material in the extractor averages about 40 to about 50 minutes. Wet extracted tobacco stem material is removed from one end of the extractor, a liquid extract having a tobacco extract content of about 18 to about 21.5 percent is collected at the other end of the extractor. The tobacco material entering the extractor has about 35.5 percent hot water solubles and the extracted mixture has about 10 to about 11 percent hot water solubles, representing a removal of about 77 to about 81 percent of the hot water solubles from the stems, on a dry weight basis.

The liquid extract is concentrated to a concentration of about 30 percent dissolved solids using a thin film evaporator. Then, the resulting concentrated aqueous extract is spray dried by continuously pumping the liquid aqueous extract to an Anhydro Size No. 1 spray dryer. The inlet temperature of the spray dryer is about 215° C. and the outlet temperature is about 85° C. The dried powder is collected at the outlet of the spray dryer. The spray dried extract exhibits a moisture content of about 5 percent. The nitrate content of the spray dried extract is about 29.5 percent.

Spray dried Burley tobacco extract is contacted with tap water at abut 150° F. so as to provide about 95 pounds of an aqueous tobacco extract including about 0.84 parts extract and about 1 part water. To the aqueous tobacco extract is added about 9.5 pounds of high fructose corn syrup available from Corn Products Co. Then, the resulting liquid aqueous extract is provided in an open jacketed container and heated using a stem jacket at ambient pressure over about 15 minutes to a temperature of about 200° F. The heated aqueous extract is maintained at about 200° F. to about 218° F. for about 1 hour. After heating, the liquid aqueous extract includes about 49 percent extract due to the evaporation of some of the water and certain volatile tobacco components. Then, the heated liquid aqueous tobacco extract is pumped into 5 gallon polyethylene buckets positioned in ice buckets. The aqueous extracts are cooled overnight at ambient pressure to about 85° F. without stirring. The liquid aqueous extract at about 85° F. then is separated from solid potassium nitrate crystals. The nitrate content of the processed extract and solvent which is collected is about 2.7 percent. As such, about 18.6 percent of the nitrate of the original tobacco extract is removed therefrom.

EXAMPLE 2

Spray dried Burley tobacco extract is provided as described in Example 1. The extract is contacted with tap water at about 150° F. so as to provide about 95 pounds of an aqueous tobacco extract including about 0.84 parts extract and about 1 part water. To the aqueous extract is added about 4.35 pounds of high fructose corn syrup available from Corn Products Co. Then, the resulting liquid aqueous extract is provided in an open jacketed container and heated using a steam jacket at ambient pressure over about 15 minutes to a temperature of about 200° F. The heated aqueous extract is maintained at about 200° F. to about 218° F. for about 1 hour. After heating, the liquid aqueous extract includes about 44.5 parts extract due to the evaporation of some of the water and certain volatile tobacco components. Then, the heated liquid aqueous tobacco extract is pumped into 5 gallon polyethylene buckets positioned in ice buckets. The aqueous extracts are cooled at ambient pressure to about 85° F. without stirring. The liquid aqueous extract at about 85° F. then is separated from solid potassium nitrate crystals. The nitrate content of the processed extract and solvent which is collected is about 2.7 percent. As such, about 59 percent of the nitrate of the original tobacco extract is removed therefrom.

EXAMPLE 3

Spray dried Burley tobacco extract is provided as described in Example 1. The extract is contacted with tap water at about 160° F. so as to provide an aqueous tobacco extract including about 1 part extract and about 1 part water. Then, the resulting liquid aqueous extract is provided in an open jacketed container and heated using a steam jacket at ambient pressure over about 10 minutes to a temperature of about 200° F. The heated aqueous extract is maintained at about 200° F. for about 1 hour. After heating, the liquid aqueous extract includes about 43 percent extract due to the evaporation of some of the water and certain volatile tobacco components. Then, the heated liquid aqueous tobacco extract is pumped into metal buckets. The aqueous extracts are cooled overnight at ambient pressure to about 85° F. The liquid aqueous extract at about 85° F. then is separated from solid potassium nitrate crystals. The resulting aqueous extract includes about 41 percent tobacco extract and about 59 percent water. The nitrate content of the processed extract and solvent which is collected is about 2.3 percent. As such, about 56 percent of the nitrate of the original tobacco extract is removed therefrom.

EXAMPLE 4

Spray dried Burley tobacco extract is provided as described in Example 1. The extract is contacted with tap water at about 150° F. so as to provide an aqueous tobacco extract including about 0.84 part extract and about 1 part water. Then, the resulting liquid aqueous extract is provided in an open jacketed container and heated using a steam jacket at ambient pressure over about 10 minutes to a temperature of about 200° F. The heated aqueous extract is maintained at about 200° F. to about 217° F. for about 1 hour. After heating, the liquid aqueous extract includes about 45 percent extract and about 55 percent water due to the evaporation of some of the water and certain volatile tobacco components. Then, the heated liquid aqueous tobacco extract is pumped into 5 gallon polyethylene buckets positioned in ice buckets. The aqueous extracts are cooled overnight at ambient pressure to about 85° F. The liquid aqueous extract at about 85° F. then is separated from solid potassium nitrate crystals. The nitrate content of the processed extract and solvent which is collected is about 2.6 percent. As such, about 27 percent of the nitrate of the original tobacco extract is removed therefrom.

What is claimed is:

1. A process for removing components from a tobacco extract, the process comprising the steps of:

(i) extracting components from a tobacco material under extraction conditions using an extraction solvent having an aqueous character, so as to provide an aqueous tobacco extract and a tobacco portion insoluble in the solvent;

(ii) separating at least a portion of the aqueous tobacco extract from the tobacco portion insoluble in the solvent;

(iii) providing the tobacco extract within extraction solvent in an amount of at least 30 weight percent, based on extract and solvent weight;

(iv) subjecting the extract and solvent to heat treatment to above 120° F.;

(v) cooling the extract and solvent to less than about 100° F. to form a precipitate; and (vi) separating resulting precipitate from the extract and solvent.

2. The process of claim 1 whereby the tobacco material includes Burley tobacco stem and the precipitate includes potassium nitrate crystals.

3. The process of claim 1 or 2 whereby the extract and solvent are not cooled to below about 35° F. in step (v).

4. The process of claim 1 or 2 whereby the extract and solvent are not cooled to below about 40° F. in step (v).

5. The process of claim 1 or 2 whereby the extract and solvent are heated to a temperature of about 130° F. to about 200° F. in step (iv).

6. The process of claim 1 of 2 whereby the tobacco material is subjected to extraction conditions at a temperature of about 40° F. to about 190° F. in step (i).

7. The process of claim or 2 whereby the tobacco extract is provided within the extraction solvent in step (iii) in an amount of less than about 50 weight percent, based on the extract and solvent weight.

8. The process of claim 1 or 2 whereby the tobacco extract is provided within the extraction solvent in step (iii) in an amount of greater than about 35 weight percent, based on the extract and solvent weight.

9. The process of claim 1 or 2 whereby the tobacco extract and solvent are heated to a temperature of at least about 140° F. in step (iv).

10. The process of claim 1 or 2 whereby the tobacco extract and solvent are heated to a temperature not exceeding about 250° F. in step (iv).

11. The process of claim 1 or 2 whereby the tobacco extract and solvent are heated to a temperature of about 140° F. to about 180° F. in step (iv).

12. The process of claim 1 or 2 whereby the tobacco extract and solvent are not cooled to a temperature below about 45° F. in step (v).

13. The process of claim 1 or 2 whereby the tobacco extract and solvent are cooled to a temperature of about 60° F. to about 90° F. in step (v).

14. The process of claim 2 whereby the tobacco extract and solvent are subjected to conditions sufficient to remove about 15 to 60 percent of the potassium nitrate present in the tobacco extract as precipitate.

* * * * *